US012256772B2

(12) United States Patent
Zuber et al.

(10) Patent No.: US 12,256,772 B2
(45) **Date of Patent: *Mar. 25, 2025**

(54) AEROSOL-GENERATING ARTICLE FOR USE WITH AN AEROSOL-GENERATING DEVICE

(71) Applicant: Philip Morris Products S.A., Neuchatel (CH)

(72) Inventors: Gerard Zuber, Froideville (CH); Cedric Meyer, Lausanne (CH); Alexis Louvet, Lausanne (CH); Marine Jarriault, Bern (CH); Thomas Badertscher, Cernier (CH); Pierre-Yves Gindrat, Saxon (CH); Daniele Sanna, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 61 days.

This patent is subject to a terminal disclaimer.

(21) Appl. No.: 17/563,292

(22) Filed: Dec. 28, 2021

(65) Prior Publication Data

US 2022/0117293 A1 Apr. 21, 2022

Related U.S. Application Data

(63) Continuation of application No. 14/362,768, filed as application No. PCT/EP2012/077077 on Dec. 28, 2012, now Pat. No. 11,272,731.

(30) Foreign Application Priority Data

Dec. 30, 2011 (EP) ..... 11196203
Dec. 30, 2011 (EP) ..... 11196204
(Continued)

(51) Int. Cl.
*A24D 1/20* (2020.01)
*A24F 40/20* (2020.01)
*A24F 40/46* (2020.01)

(52) U.S. Cl.
CPC ..... *A24D 1/20* (2020.01); *A24F 40/20* (2020.01); *A24F 40/46* (2020.01)

(58) Field of Classification Search
None
See application file for complete search history.

(56) References Cited

U.S. PATENT DOCUMENTS 2,001,709 A 5/1935 Davidson
2,039,298 A 5/1936 Davidson
(Continued)

FOREIGN PATENT DOCUMENTS

CH 649 032 A5 4/1985
CH 670 420 A5 6/1989
(Continued)

OTHER PUBLICATIONS

Official Action (Notice of Hearing) issued in corresponding Indian Patent Application No. 4027/DELNP/14 (with English translation), 3 pages.

(Continued)

*Primary Examiner* — Phu H Nguyen
(74) *Attorney, Agent, or Firm* — Oblon, McClelland, Maier & Neustadt, L.L.P.

(57) ABSTRACT

An aerosol-generating article for an aerosol-generating device including a heating element is provided, the aerosol-generating article including: an aerosol-forming substrate including homogenised tobacco material; a support element disposed immediately downstream of the aerosol-forming substrate; an aerosol-cooling element disposed downstream of the support element; and an outer wrapper circumscribing (Continued)

the aerosol-forming substrate, the support element, and the aerosol-cooling element, the support element abutting the aerosol-forming substrate.

23 Claims, 2 Drawing Sheets

(30) Foreign Application Priority Data

| | | |
|---|---|---|
| Feb. 13, 2012 | (EP) | 12155248 |
| Feb. 13, 2012 | (EP) | 12155250 |
| Jun. 21, 2012 | (EP) | 12173054 |

(56) References Cited

U.S. PATENT DOCUMENTS

| | | | |
|---|---|---|---|
| 2,164,702 | A | 7/1939 | Davidson |
| 2,827,903 | A | 3/1958 | Niederman |
| 2,852,987 | A | 9/1958 | Eislingen et al. |
| 2,979,058 | A | 4/1961 | Schur |
| 2,992,648 | A | 7/1961 | Weiss et al. |
| 2,995,481 | A | 8/1961 | Müller |
| 3,122,145 | A | 2/1964 | Louis |
| 3,238,852 | A | 3/1966 | Schur et al. |
| 3,240,213 | A | 3/1966 | Miller |
| 3,246,655 | A | 4/1966 | Spears |
| 3,472,236 | A | 10/1969 | Dearsley |
| 3,518,921 | A | 7/1970 | Müller |
| 3,744,497 | A | 7/1973 | Marciuliano |
| 3,818,809 | A | 6/1974 | Sylvester |
| 3,860,012 | A | 1/1975 | Selke |
| 3,894,544 | A | 7/1975 | Egri |
| 3,894,545 | A | 7/1975 | Crellin et al. |
| 3,957,062 | A | 5/1976 | Labbe et al. |
| 3,991,773 | A | 11/1976 | Walker |
| 4,000,748 | A | 1/1977 | Summers |
| 4,003,684 | A | 1/1977 | Müller et al. |
| 4,007,745 | A | 2/1977 | Randall |
| 4,047,536 | A | 9/1977 | Asfour |
| 4,168,712 | A | 9/1979 | Labbé |
| 4,281,671 | A | 8/1981 | Bynre et al. |
| 4,289,725 | A | 9/1981 | Müller et al. |
| 4,291,711 | A | 9/1981 | Berger |
| 4,355,995 | A | 10/1982 | Berger |
| 4,391,285 | A | 7/1983 | Burnett et al. |
| 4,807,808 | A | 2/1989 | Reed |
| 4,807,809 | A | 2/1989 | Pryor et al. |
| 4,819,665 | A | 4/1989 | Roberts |
| 4,903,714 | A | 2/1990 | Barnes et al. |
| 4,913,169 | A | 4/1990 | Templeton |
| 4,922,901 | A | 5/1990 | Brooks |
| 4,928,714 | A | 5/1990 | Shannon |
| 5,016,656 | A | 5/1991 | McMurtrie |
| 5,027,837 | A | 7/1991 | Clearman et al. |
| 5,033,484 | A | 7/1991 | Seidel et al. |
| 5,101,839 | A | 4/1992 | Jakob et al. |
| 5,105,837 | A | 4/1992 | Barnes et al. |
| 5,144,962 | A | 9/1992 | Counts et al. |
| 5,247,947 | A | 9/1993 | Clearman |
| 5,261,425 | A | 11/1993 | Raker et al. |
| 5,271,419 | A | 12/1993 | Arzonico et al. |
| 5,322,075 | A | 6/1994 | Deevi et al. |
| 5,345,955 | A | 9/1994 | Clearman et al. |
| 5,360,023 | A | 11/1994 | Blakley et al. |
| 5,388,594 | A | 2/1995 | Counts et al. |
| 5,413,121 | A | 5/1995 | Dawson et al. |
| 5,433,224 | A | 7/1995 | Luke et al. |
| 5,469,871 | A | 11/1995 | Barnes et al. |
| 5,499,636 | A | 3/1996 | Baggett, Jr. et al. |
| 5,505,214 | A | 4/1996 | Collins et al. |
| 5,613,504 | A | 3/1997 | Collins et al. |
| 5,671,757 | A | 9/1997 | Woodings |
| 5,685,323 | A | 11/1997 | Crooks et al. |
| 5,692,526 | A | 12/1997 | Adams et al. |
| 5,709,227 | A | 1/1998 | Arzonico et al. |
| 5,724,998 | A | 3/1998 | Gellatly et al. |
| 5,819,751 | A | 10/1998 | Barnes et al. |
| 6,026,820 | A | 2/2000 | Baggett, Jr. et al. |
| 6,385,333 | B1 | 5/2002 | Puckett et al. |
| 6,761,175 | B2 | 7/2004 | Nakanishi et al. |
| 6,857,431 | B2 | 2/2005 | Deevi |
| 7,856,990 | B2 | 12/2010 | Crooks et al. |
| 7,998,274 | B2 | 8/2011 | Rodrigues et al. |
| 2002/0096300 | A1 | 7/2002 | Yamashita |
| 2003/0154991 | A1 | 8/2003 | Fournier et al. |
| 2004/0110633 | A1 | 6/2004 | Deevi et al. |
| 2004/0194792 | A1 | 10/2004 | Zhuang et al. |
| 2005/0039767 | A1 | 2/2005 | Mua et al. |
| 2005/0066985 | A1 | 3/2005 | Borschke et al. |
| 2005/0072438 | A1 | 4/2005 | Darwish |
| 2005/0172976 | A1 | 8/2005 | Newman et al. |
| 2006/0011206 | A1 | 1/2006 | Clarke |
| 2006/0021624 | A1 | 2/2006 | Gonterman et al. |
| 2006/0185687 | A1 | 8/2006 | Hearn et al. |
| 2007/0023056 | A1 | 2/2007 | Cantrell et al. |
| 2007/0235050 | A1 | 10/2007 | Li et al. |
| 2008/0029114 | A1 | 2/2008 | Seitert et al. |
| 2008/0092912 | A1 | 4/2008 | Robinson et al. |
| 2008/0163879 | A1 | 7/2008 | Rodrigues et al. |
| 2009/0038629 | A1 | 2/2009 | Ergle et al. |
| 2009/0044817 | A1 | 2/2009 | Besso et al. |
| 2009/0065011 | A1 | 3/2009 | Maeder et al. |
| 2009/0301503 | A1 | 12/2009 | Peter et al. |
| 2010/0024834 | A1 | 2/2010 | Oglesby et al. |
| 2010/0024864 | A1 | 2/2010 | Kim et al. |
| 2010/0059070 | A1 | 3/2010 | Potter et al. |
| 2010/0059074 | A1 | 3/2010 | Brantley et al. |
| 2010/0154809 | A1 | 6/2010 | Seitert et al. |
| 2010/0200006 | A1 | 8/2010 | Robinson et al. |
| 2010/0275935 | A1 | 11/2010 | Fiebelkorn |
| 2010/0313901 | A1 | 12/2010 | Fernando |
| 2011/0036364 | A1 | 2/2011 | Pienemann et al. |
| 2011/0036367 | A1 | 2/2011 | Saito et al. |
| 2011/0155718 | A1 | 6/2011 | Greim et al. |
| 2011/0290269 | A1 | 12/2011 | Shimizu |
| 2012/0017925 | A1 | 1/2012 | Sebastian et al. |
| 2012/0031414 | A1 | 2/2012 | Atchley et al. |
| 2012/0048286 | A1 | 3/2012 | Luan et al. |
| 2012/0060853 | A1 | 3/2012 | Robinson et al. |
| 2012/0060855 | A1 | 3/2012 | Fiebelkorn |
| 2012/0067360 | A1 | 3/2012 | Conner et al. |
| 2012/0234821 | A1 | 9/2012 | Shimizu |
| 2012/0247494 | A1 | 10/2012 | Oglesby et al. |
| 2012/0305015 | A1 | 12/2012 | Sebastian et al. |
| 2013/0019886 | A1 | 1/2013 | White et al. |
| 2014/0305448 | A1 | 10/2014 | Zuber et al. |
| 2015/0027474 | A1 | 1/2015 | Zuber et al. |

FOREIGN PATENT DOCUMENTS

| | | | |
|---|---|---|---|
| CH | 691 156 | A5 | 5/2001 |
| CN | 88 1 01084 | A | 9/1988 |
| CN | 1035040 | A | 8/1989 |
| CN | 1059266 | A | 3/1992 |
| CN | 1190335 | A | 8/1998 |
| CN | 1248888 | A | 3/2000 |
| CN | 1262691 | A | 8/2000 |
| CN | 1316205 | A | 10/2001 |
| CN | 1333657 | A | 1/2002 |
| CN | 1113620 | C | 7/2003 |
| CN | 1633247 | A | 6/2005 |
| CN | 1708241 | A | 12/2005 |
| CN | 1744833 | | 3/2006 |
| CN | 1961765 | A | 5/2007 |
| CN | 101094599 | A | 12/2007 |
| CN | 101132823 | A | 2/2008 |
| CN | 101263935 | A | 9/2008 |
| CN | 201127292 | Y | 10/2008 |
| CN | 101351128 | A | 1/2009 |
| CN | 101396173 | A | 4/2009 |
| CN | 101437415 | A | 5/2009 |
| CN | 101500441 | A | 8/2009 |
| CN | 101500442 | A | 8/2009 |

(56) References Cited

FOREIGN PATENT DOCUMENTS

| | | | |
|---|---|---|---|
| CN | 101500443 | A | 8/2009 |
| CN | 101631478 | A | 1/2010 |
| CN | 101301111 | B | 6/2010 |
| CN | 101778578 | A | 7/2010 |
| CN | 101790329 | A | 7/2010 |
| CN | 101925309 | A | 12/2010 |
| CN | 101970323 | A | 2/2011 |
| CN | 102088875 | A | 6/2011 |
| CN | 102266121 | A | 12/2011 |
| CN | 102392316 | A | 3/2012 |
| CN | 201379072 | Y | 1/2020 |
| DE | 879823 | C | 6/1953 |
| DE | 1 632 239 | B1 | 3/1972 |
| DE | 198 54 009 | A1 | 5/2000 |
| EP | 0 212 234 | A2 | 3/1987 |
| EP | 0 307 090 | A1 | 3/1989 |
| EP | 0 340 808 | A2 | 11/1989 |
| EP | 0 342 538 | A2 | 11/1989 |
| EP | 0 471 581 | A1 | 2/1992 |
| EP | 0 476 349 | A2 | 3/1992 |
| EP | 0 503 767 | A1 | 9/1992 |
| EP | 0 532 329 | A2 | 3/1993 |
| EP | 0 535 695 | A2 | 4/1993 |
| EP | 0 530 251 | B1 | 9/1995 |
| EP | 0 777 977 | | 6/1997 |
| EP | 0 822 670 | A2 | 2/1998 |
| EP | 0 822 760 | A2 | 2/1998 |
| EP | 0 608 047 | B1 | 7/1998 |
| EP | 1 889 550 | A1 | 2/2008 |
| EP | 2 025 251 | A1 | 2/2009 |
| EP | 2 062 484 | A1 | 5/2009 |
| EP | 2 100 840 | A1 | 9/2009 |
| EP | 2 289 357 | A1 | 3/2011 |
| EP | 2 340 730 | A1 | 7/2011 |
| EP | 2 394 520 | | 12/2011 |
| EP | 2 757 911 | A | 7/2014 |
| GB | 793114 | A | 4/1958 |
| GB | 983928 | | 2/1965 |
| GB | 988811 | A | 4/1965 |
| GB | 994169 | A | 6/1965 |
| GB | 866803 | A | 5/1967 |
| GB | 1 124 434 | | 8/1968 |
| GB | 1151634 | A | 5/1969 |
| GB | 1197174 | | 7/1970 |
| GB | 2 020 158 | A | 11/1979 |
| GB | 2 473 264 | A | 3/2011 |
| JP | 50-105896 | A | 8/1975 |
| JP | 51-12999 | | 1/1976 |
| JP | 52-10500 | | 1/1977 |
| JP | 64-71470 | | 3/1989 |
| JP | 1-243979 | A | 9/1989 |
| JP | 2-53476 | A | 2/1990 |
| JP | 05-103836 | A | 4/1993 |
| JP | 5-211861 | A | 8/1993 |
| JP | H05-211861 | | 8/1993 |
| JP | H08-256751 | | 10/1996 |
| JP | 9-103280 | | 4/1997 |
| JP | 9-107942 | A | 4/1997 |
| JP | 9-316420 | A | 12/1997 |
| JP | 11-103839 | A | 4/1999 |
| JP | H11-164679 | | 6/1999 |
| JP | 2002-528106 | A | 9/2002 |
| JP | 2006-504431 | | 2/2006 |
| JP | 2008-525009 | A | 7/2008 |
| JP | 2009-502194 | A | 1/2009 |
| JP | 2009-529871 | | 8/2009 |
| JP | 2010-506594 | | 3/2010 |
| JP | 2010-520742 | | 6/2010 |
| JP | 2010-520764 | A | 6/2010 |
| JP | 2010-178730 | A | 8/2010 |
| JP | 2010-535530 | | 11/2010 |
| JP | 2011-509667 | A | 3/2011 |
| JP | 2011-512853 | A | 4/2011 |
| JP | 2011-115141 | | 6/2011 |
| JP | 2015-517817 | A | 6/2015 |
| JP | 2015-523857 | A | 8/2015 |
| KR | 10-1993-0000048 | A | 1/1993 |
| KR | 1996-0007797 | B1 | 6/1996 |
| KR | 0178388 | | 2/1999 |
| KR | 10-2001-0013020 | | 2/2001 |
| KR | 10-0393327 | B1 | 10/2003 |
| KR | 10-2004-0084899 | A | 10/2004 |
| KR | 10-0636287 | B1 | 10/2006 |
| KR | 10-0844445 | B1 | 7/2008 |
| KR | 10-2009-0046820 | | 5/2009 |
| KR | 10-2010-0054141 | | 5/2010 |
| KR | 10-2010-0121539 | A | 11/2010 |
| KZ | 11053 | | 12/2001 |
| RU | 2 214 141 | C2 | 10/2003 |
| RU | 2 346 629 | C2 | 2/2009 |
| RU | 2 356 458 | C2 | 5/2009 |
| RU | 2008 131 960 | A | 2/2010 |
| RU | 2 410 993 | C2 | 2/2011 |
| TW | 209162 | | 7/1993 |
| TW | 200934399 | A | 8/2009 |
| TW | 200942185 | A1 | 10/2009 |
| TW | 201012400 | A1 | 4/2010 |
| TW | 201043157 | A1 | 12/2010 |
| UA | 88318 | C2 | 10/2009 |
| WO | 94/06314 | A1 | 3/1994 |
| WO | 95/10950 | A2 | 4/1995 |
| WO | 96/32854 | A2 | 10/1996 |
| WO | 96/39880 | A1 | 12/1996 |
| WO | 98/17130 | | 4/1998 |
| WO | 01/89329 | A2 | 11/2001 |
| WO | 2004/041007 | A2 | 5/2004 |
| WO | 2005/032285 | A1 | 4/2005 |
| WO | WO 2006/048774 | A1 | 5/2006 |
| WO | 2007/108877 | A2 | 9/2007 |
| WO | 2008/015441 | A1 | 2/2008 |
| WO | 2008/015570 | A2 | 2/2008 |
| WO | 2008/108889 | A1 | 9/2008 |
| WO | 2009/021018 | A1 | 2/2009 |
| WO | 2009/022232 | A2 | 2/2009 |
| WO | 2009/143338 | A2 | 11/2009 |
| WO | 2010/028354 | A1 | 3/2010 |
| WO | 2010/047389 | A1 | 4/2010 |
| WO | 2010/113702 | A1 | 10/2010 |
| WO | 2011/045066 | A1 | 4/2011 |
| WO | 2011/068020 | A1 | 6/2011 |
| WO | 2011/077138 | A1 | 6/2011 |
| WO | 2011/101164 | A1 | 8/2011 |
| WO | 2011/141735 | A1 | 11/2011 |
| WO | 2012/012053 | A1 | 1/2012 |
| WO | 2012/014490 | A1 | 2/2012 |
| WO | 2012/164009 | A2 | 12/2012 |
| WO | 2013/076098 | A2 | 5/2013 |
| WO | 2013/098353 | A1 | 7/2013 |
| WO | 2013/098405 | A2 | 7/2013 |
| WO | 2013/098409 | A1 | 7/2013 |
| WO | 2013/098410 | A2 | 7/2013 |
| WO | 2013/120565 | A2 | 8/2013 |
| WO | 2013/120566 | A2 | 8/2013 |
| WO | 2013/178766 | A1 | 12/2013 |
| WO | 2013/178767 | A1 | 12/2013 |
| WO | 2013/178768 | A1 | 12/2013 |
| WO | 2013/178769 | A1 | 12/2013 |
| WO | 2014/102092 | A1 | 7/2014 |

OTHER PUBLICATIONS

"Determination of the Draw Resistance of Cigarettes and Filter Rods", Coresta Recommended Method Nº 41, Jun. 2007, pp. 1-19.

Office Action issued Mar. 10, 2016 in Chinese Patent Application No. 201280072200.7 (English-language Translation only), 8 pages.

Combined Office Action and Search Report issued Jun. 3, 2016 in Chinese Patent Application No. 201380034575.9 (submitting English translation only), 12 pages.

Combined Chinese Office Action and Search Report issued Jun. 20, 2016 in Patent Application No. 201380034799.X (submitting English translation only), 11 pages.

(56) References Cited

OTHER PUBLICATIONS

Combined Chinese Office Action and Search Report issued Jun. 27, 2016 in Patent Application No. 201380034602.2 (submitting English translation only), 11 pages.
Combined Office Action and Search Report issued Jul. 5, 2016 in Chinese Patent Application No. 201380031712.3 (submitting English translation only), 5 pages.
Combined Search Report and Office Action issued Jan. 4, 2017 in Chinese Patent Application No. 201380031712.3 (English translation only), 7 pages.
Combined Office Action and Search Report issued Feb. 20, 2017 in Chinese Patent Application No. 201380034602.2 (English translation only), 8 pages.
Office Action issued Nov. 13, 2019 in Chinese Application No. 201711346822.5, along with an English translation, 22 pages.
Combined Chinese Office Action and Search Report issued on Dec. 11, 2019, in Patent Application No. 201711347424.5, 21 pages.
Combined Chinese Office Action and Search Report issued Jun. 29, 2020 in corresponding Chinese Patent Application No. 201711346822.5 (with English Translation), 20 pages.
Chinese Office Action issued Jul. 17, 2020 in corresponding Chinese Application No. 201711347424.5 (with English translation), 17 pages.
Extended Search Report issued Oct. 29, 2012 in European patent Application No. 12170358.1, 6 pages.
Extended Search Report issued Oct. 30, 2012, in European Patent Application No. 12170359.9, 6 pages.
Extended Search Report issued Nov. 27, 2012 in European Patent Application No. 12170360.7, 4 pages.
Extended Search Report issued Mar. 19, 2013 in 12170356.5, 8 pages.
Partial Search Report issued Nov. 30, 2012 in European Patent Application No. 12170356.5, 7 pages.
Office Action issued Dec. 11, 2017 in Europe Patent Application No. 13 726 206.9, 5 pages.
International Search Report Issued Sep. 30, 2013 in PCT/EP13/061209 Filed May 30, 2013, 6 pages.
International Search Report and Written Opinion issued Sep. 30, 2013 in PCT/EP2013/061210 filed May 30, 2013, 4 pages.
International Search Report issued Oct. 2, 2013, in PCT/2013/061208 Filed May 30, 2013, 2 pages.
International Search Report and Written Opinion issued Oct. 7, 2013 in PCT/EP2013/061211 filed May 30, 2013, 10 pages.
International Search Report issued Oct. 8, 2013, in PCT/EP12/077087 filed Dec. 28, 2012, 8 pages.
International Search Report issued Jan. 24, 2014, in PCT/EP12/077086, filed Dec. 28, 2012, 3 pages.
Written Opinion of the International Searching Authority Issued Sep. 30, 2013 in PCT/EP13/061209 filed May 30, 2013, 3 pages.
Written Opinion issued Oct. 2, 2013 in PCT/EP2013/061208 filed May 30, 2013, 4 pages.
Written Opinion of the International Searching Authority issued Oct. 8, 2013, in PCT/EP12/077087 filed Dec. 28, 2012, 7 pages.
Written Opinion of the International Searching Authority issued Jun. 23, 2014, in PCT/EP12/077086, filed Dec. 28, 2012, 4 pages.
International Preliminary Report on Patentability issued Aug. 14, 2014 in PCT/EP2012/077086, 5 pages.
International Preliminary Report on Patentability (IPRP) issued in PCT/EP2012/077087 on Oct. 29, 2014, 15 pages.
International Preliminary Report on Patentability issued Dec. 2, 2014 in PCT/EP2013/061209 filed May 30, 2013, 4 pages.
International Preliminary Report on Patentability issued Dec. 2, 2014 in PCT/EP2013/061210 filed on May 30, 2013, 4 pages.
International Preliminary Report on Patentability issued Dec. 2, 2014 in PCT/EP2013/061211 filed May 30, 2013, 6 pages.
International Preliminary Report on Patentability issued Dec. 11, 2014 in PCT/EP2013/061208 filed May 30, 2013, 6 pages.
Israeli Office Action with English translation mailed on Mar. 13, 2019 in corresponding Israeli Patent Application No. 235629, 7 pages.
Office Action issued Mar. 29, 2017 in Japanese Patent Application No. 2015-514514 (with unedited computer generated English translation), 7 pages.
Office Action issued Mar. 29, 2017 in Japanese Patent Application No. 2015-514513 (with unedited computer generated English translation), 7 pages.
Office Action issued Mar. 29, 2017 in Japanese Patent Application No. 2015-514511 (with unedited computer generated English translation), 8 pages.
English language translation only of Japanese Office Action mailed on Apr. 17, 2017 in corresponding Japanese Patent Application No. 2015-514512, 5 pages.
Office Action issued Dec. 6, 2017 in Japanese Patent Application No. 2015-514511 (with English language translation), 8 pages.
Japanese Pre-Appeal Review report with English translation mailed on Feb. 27, 2018 in corresponding Japanese Patent Application No. 2015-514514, 4 pages.
Office Action issued Feb. 28, 2018 in Japanese Patent Application No. 2015-514512 (with English language translation), 6 pages.
Japanese Office Action with English translation mailed on Dec. 17, 2018 in corresponding Japanese Patent Application No. 2017-250915, 7 pages.
Japanese Office Action with English translation mailed on Aug. 30, 2019 in corresponding Japanese Patent Application No. 2018-122637, 8 pages.
Office Action issued Aug. 23, 2016 in Kazak Patent Application No. 2014/2552.1 (submitting English translation only), 3 pages.
Notice of Allowance issued Apr. 7, 2016 in Korean Patent Application No. 10-2014-7024000 (English-language Translation only), 1 page.
Korean Notice of Allowance issued Jun. 24, 2020 in corresponding Korean Application No. 10-2014-7033532 (with English translation), 3 pages.
Korean Notice of Allowance issued Jun. 25, 2020 in corresponding Korean Application No. 10-2014-7034539 (with English translation), 3 pages.
Jones, S. 0., "Evaluation of Filter Plugs Prepared From 21-Pound Foil Backing Paper Using the RJR Corrugating Machine" RJ Reynolds, RDM, 1958, No. 70, https://www.industrydocuments.ucsf.edu/lobacco/docs/#id=rzxn0096 (Year: 1958).
Chinese Office Action issued Feb. 23, 2021 in corresponding Chinese Patent Application No. 201810597257.8 (with English translation), 19 pages.
Zhang Huailing, et al., "Blended Type Cigarettes, First Edition", China Light Industry Press, Nov. 30, 1997, 6 pages.
Combined Chinese Office Action and Search Report issued Apr. 1, 2021 in corresponding Chinese Patent Application No. 201910426523.5 (with English translation), 21 pages.
Chinese Office Action issued Jun. 25, 2021, in corresponding Chinese Patent Application No. 201910622233.8 (with English translation), 19 pages.
New Zealand Office Action issued Nov. 10, 2015 in Patent Application No. 703078, 3 pages.
English translation only of Decision to Grant dated Apr. 24, 2017 and received in corresponding Russian Application No. 2014153579/12(085605), 4 pages.
Russian Office Action issued Jun. 8, 2017 in Patent Application No. 2014153639 (with English Translation), 11 pages.
Russian Office Action issued Jun. 23, 2017 in Patent Application No. 2014153008 (with English Translation), 11 pages.
Taiwanese Search Report with English translation mailed on Jul. 10, 2017 in the corresponding Taiwanese Patent Application No. 101151338, 10 pages.
Chinese Office Action issued Jul. 10, 2020 in corresponding Chinese Application No. 201810597257.8 (with English translation), 10 pages.
China Tobacco Yearbook: 1998-1999 (vol. 2) (compiled by the State Tobacco Monopoly Administration, Beijing: The Economic Daily Press, Dec. 2000, pp. 573-574), 3 pages.
International Preliminary Report on Patentability issued Nov. 13, 2014 in PCT/EP213/062869 filed Jun. 20, 2013.
International Search Report issued Nov. 26, 2013 in PCT/EP2013/062869.

(56) References Cited

OTHER PUBLICATIONS

Extended Search Report issued Nov. 5, 2012 in European Patent Application No. 12173054.3.
Extended European Search Report issued Dec. 20, 2019 in European Application No. 19189686.9.
Notice of Allowance issued Oct. 31, 2019 in Korean Patent Application No. 10-2014-7012246.
"Special Filter Rod—Part 1: Acetate Fiber Flute Filter Rod" China Tobacco Industry Standard YC/T 223-1-2007, Jul. 5, 2007, 11 pages (11 pages).
Chinese Office Action issued on Feb. 13, 2018 in Patent Application No. 201380044053.7 with English translation, dated Feb. 13, 2018 (254 pages).
Korean Search Report issued on Dec. 16, 2015 in Patent Application No. 10-2014-7036378.
Office Action issued Sep. 11, 2017 in European Patent Application No. 12 821 115.8.
Office Action issued on Jul. 29, 2016 in Russian Patent Application No. 2015101642/12(002456) (submitting English translation only).
Office Action issued Mar. 22, 2016 in Japanese Patent Application No. 2015-517760 (submitting English translation only).
Korean Office Action issued Apr. 8, 2016 in Patent Application No. 10-2014-7036378 (English translation only).
Combined Office Action and Search Report issued Apr. 19, 2017 in Taiwanese Patent Application No. 102121900 (submitting English translation only).
Combined Chinese Office Action and Search Report issued on Aug. 2, 2016 in Patent Application No. 201380044053.7 (submitting English translation only).
Chinese Office Action received in the corresponding Chinese application No. 201280061528.9 (Date of Notification: May 3, 2017).
Chinese Office Action dated Mar. 8, 2017(English translation only) received in corresponding Chinese Application No. 201280064910.5, (7 pages).
English translation only of Japanese Office Action dispatched on Oct. 17, 2016 in Japanese Patent Application No. JP 2014-549499, (3 pages).
English translation only of Chinese Office Action dated Nov. 25, 2016 in corresponding Chinese Application No. 201280061528.9, ( 4 pages).
International Search Report Issued Jul. 5, 2013 in PCT/EP12/077077 filed Dec. 28, 2012.
Written Opinion of the International Searching Authority Issued Jul. 5, 2013 in PCT/EP12/077077 filed Dec. 28, 2012.
International Search Report issued Feb. 6, 2014 in PCT/EP2012/077092 filed Dec. 28, 2012.
Written Opinion of the International Searching Authority issued Feb. 6, 2014 in PCT/EP2012/077092 filed Dec. 28, 2012.
International Search Report Issued Jun. 11, 2013 in PCT/EP12/077091 filed Dec. 28, 2012.
Written Opinion of the International Searching Authority Issued Jun. 11, 2013 in PCT/EP12/077091 filed Dec. 28, 2012.
Combined Office Action and Search Report issued Jan. 14, 2016 in Chinese Patent Application No. 201280061528.9 (with English translation only).
Office Action issued Dec. 8, 2015 in Kazakhstani Patent Application No. 2014/1655.1 (English translation only).
Combined Office Action and Search Report issued Dec. 14, 2015 in Chinese Patent Application No. 201280061532.5 (English translation only).
Office Action issued Mar. 21, 2015 in Korean Patent Application No. 10-2014-7012121 (with English translation only).
Office Action issued Dec. 9, 2021 in co-pending U.S. Appl. No. 14/402,482, 11 pages.
Combined Chinese Office Action and Search Report issued Dec. 13, 2021 in corresponding Chinese Patent Application No. 201910426523.5 (with English translation), 21 pages.
"Effect of Polyethylene Glycol, Triacetin and Glycerin on the Cellulose Acetate Plasticizing", Korean Polymer Society, vol. 39, No. 4, pp. 649-654 (2015) (R4), http://dx.doi.org/10.7317/pk.2015.39.4.649 (with partial machine English translation). 12 pages.

AEROSOL-GENERATING ARTICLE FOR USE WITH AN AEROSOL-GENERATING DEVICE

CROSS-REFERENCE TO RELATED APPLICATIONS

This application is a continuation application of and claims benefit under 35 U.S.C. § 120 to U.S. application Ser. No. 14/362,768, filed on Jun. 4, 2014, which is a U.S. national stage application of PCT/EP2012/077077, filed on Dec. 28, 2012, and claims benefit of priority under 35 U.S.C. § 119 to EP 11196203.1, filed on Dec. 30, 2011, EP 11196204.9, filed on Dec. 30, 2011, EP 12155248.3, filed on Feb. 13, 2012, EP 12155250.9, filed on Feb. 13, 2012, and EP 12173054.3, filed on Jun. 21, 2012, the entire contents of each of which are incorporated herein by reference.

TECHNICAL FIELD

The present specification relates to an aerosol-generating article comprising an aerosol-forming substrate for generating an inhalable aerosol when heated by a heating element of an aerosol-generating device. The specification also relates to a method of using such an aerosol-generating article.

DESCRIPTION OF THE RELATED ART

A number of smoking articles in which tobacco is heated rather than combusted have been proposed in the art. One aim of such heated smoking articles is to reduce known harmful smoke constituents of the type produced by the combustion and pyrolytic degradation of tobacco in conventional cigarettes.

Typically in such heated smoking articles, an aerosol is generated by the transfer of heat from a heat source to a physically separate aerosol-forming substrate or material, which may be located within, around or downstream of the heat source. During smoking, volatile compounds are released from the aerosol-forming substrate by heat transfer from the heat source and entrained in air drawn through the smoking article. As the released compounds cool, they condense to form an aerosol that is inhaled by the user.

A number of prior art documents disclose aerosol-generating devices for consuming or smoking heated smoking articles. Such devices include, for example, electrically heated aerosol-generating devices in which an aerosol is generated by the transfer of heat from one or more electrical heating elements of the aerosol-generating device to the aerosol-forming substrate of a heated smoking article. One advantage of such electrical smoking systems is that they significantly reduce sidestream smoke, while permitting a user to selectively suspend and reinitiate smoking.

An example of an electrically heated cigarette used in an electrical smoking system is disclosed in US 2005/0172976 A1. The electrically heated cigarette is constructed to be inserted into and a cigarette receiver of a reusable lighter of an electrical smoking system. The lighter includes a power source that supplies energy to a heater fixture including a plurality of electrically resistive heating elements, which are arranged to slidingly receive the cigarette such that the heating elements are positioned alongside the cigarette. The electrically heated cigarette used in an electrical smoking system disclosed in US 2005/0172976 A1 may provide the energy to the electrically heated cigarette using pulsed heating.

As described above, the electrically heated cigarette disclosed in US 2005/0172976 A1 is for use in an electrical smoking system comprising a plurality of external heating elements. Electrical smoking systems comprising aerosol-generating devices with internal heating elements are also known. In use, the internal heating elements of the aerosol-generating devices of such electrical smoking systems are inserted into the aerosol-forming substrate of a heated smoking article such that the internal heating elements are in direct contact with the aerosol-forming substrate.

Direct contact between an internal heating element of an aerosol-generating device and the aerosol-forming substrate of a heated smoking article can provide an efficient means for heating the aerosol-forming substrate to form an inhalable aerosol. In such a configuration, heat from the internal heating element may be conveyed almost instantaneously to at least a portion of the aerosol-forming substrate when the internal heating element is actuated, and this may facilitate the rapid generation of an aerosol. Furthermore, the overall heating energy required to generate an aerosol may be lower than would be the case in a smoking system comprising an external heater element where the aerosol-forming substrate does not directly contact the external heating element and initial heating of the aerosol-forming substrate occurs by convection or radiation. Where an internal heating element of an aerosol-generating device is in direct contact with an aerosol-forming substrate, initial heating of portions of the aerosol-forming substrate that are in direct contact with the internal heating element will be effected by conduction.

U.S. Pat. No. 5,499,636 discloses a cigarette adapted for use in an electrical cigarette system. The cigarette comprises a tobacco rod having filled and unfilled portions arranged so that external electrical heater elements may overlap the filled and unfilled tobacco rod portions. The cigarette is inserted into a receptacle at a front end portion of a lighter in order to be smoked.

SUMMARY

The present specification relates to an aerosol-generating article and a method of using an aerosol-generating article. In particular, the present specification relates to an aerosol-generating article comprising an aerosol-forming substrate for generating an inhalable aerosol when heated by an internal heating element of an aerosol-generating device. The specification also relates to a method of using such an aerosol-generating article with an aerosol-generating device comprising an internal heating element.

According to a first aspect, there is provided an aerosol-generating article for use in an aerosol-generating system comprising an electrically heated aerosol-generating device comprising an internal heating element. The aerosol-generating article comprises, in a linear sequential arrangement, an aerosol-forming substrate, a support element located immediately downstream of the aerosol-forming substrate, an aerosol-cooling element located downstream of the support element, and an outer wrapper circumscribing the aerosol-forming substrate, the support element and the aerosol-cooling element. The support element abuts the aerosol-forming substrate. The aerosol-forming substrate is penetrable by the heating element of the aerosol-generating device.

According to a second aspect, there is provided a method of using an aerosol-generating article according to the first aspect with an aerosol-generating device comprising a heating element. The method comprises the steps of inserting the heating element of the aerosol-generating device into the aerosol-forming substrate of the aerosol-generating article, raising the temperature of the heating element of the aerosol-generating device to heat the aerosol-forming substrate of the aerosol-generating article to generate an aerosol, and withdrawing the heating element of the aerosol-generating device from the aerosol-forming substrate of the aerosol-generating article.

According to a third aspect, there is provided an aerosol-generating system comprising: an aerosol-generating device comprising a heating element; and an aerosol-generating article for use with the aerosol-generating device. The aerosol-generating article comprises an aerosol-forming substrate, a support element located immediately downstream of the aerosol-forming substrate, an aerosol-cooling element located downstream of the support element, and an outer wrapper circumscribing the aerosol-forming substrate, the support element and the aerosol-cooling element. The support element abuts the aerosol-forming substrate. The aerosol-forming substrate is penetrable by the heating element of the aerosol-generating device.

According to a fourth aspect, there is provided a method of using an aerosol-generating system according to the third aspect. The method comprises the steps of inserting the heating element of the aerosol-generating device into the aerosol-forming substrate of the aerosol-generating article, raising the temperature of the heating element of the aerosol-generating device to heat the aerosol-forming substrate of the aerosol-generating article to generate an aerosol, and withdrawing the heating element of the aerosol-generating device from the aerosol-forming substrate of the aerosol-generating article.

BRIEF DESCRIPTION OF THE DRAWINGS

Specific embodiments will now be described with reference to the figures, in which.

DETAILED DESCRIPTION

Figure 1:
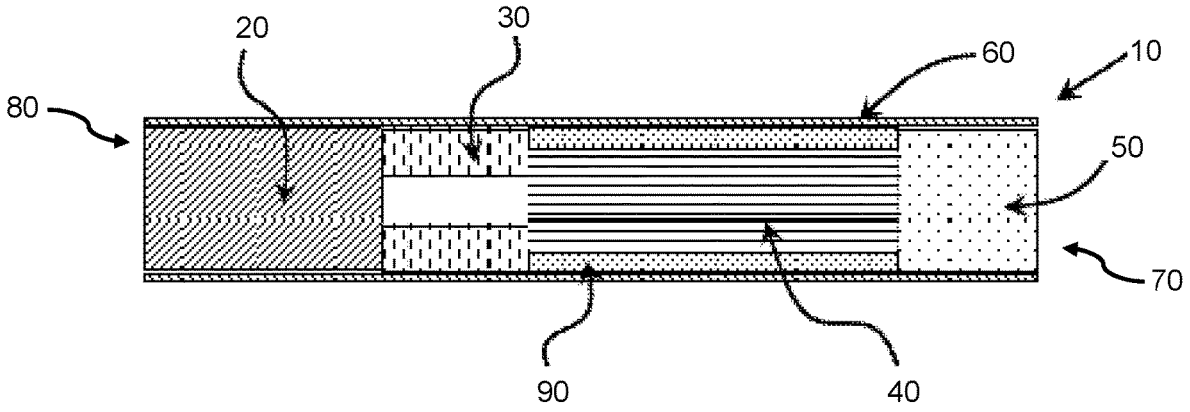
FIG. 1 is a schematic cross-sectional diagram of an embodiment of an aerosol-generating article for use with an aerosol generating-device comprising a heating element.

As used herein, the term 'aerosol-forming substrate' is used to describe a substrate capable of releasing upon heating volatile compounds, which can form an aerosol. The aerosol generated from aerosol-forming substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

As used herein, the terms 'upstream' and 'downstream' are used to describe the relative positions of elements, or portions of elements, of the aerosol-generating article in relation to the direction in which a user draws on the aerosol-generating article during use thereof.

The aerosol-generating article comprises two ends: a proximal end through which aerosol exits the aerosol-generating article and is delivered to a user and a distal end. In use, a user may draw on the proximal end in order to inhale aerosol generated by the aerosol-generating article.

The proximal end may also be referred to as the mouth end or the downstream end and is downstream of the distal end. The distal end may also be referred to as the upstream end and is upstream of the proximal end.

As used herein, the term 'aerosol-cooling element' is used to describe an element having a large surface area and a low resistance to draw. In use, an aerosol formed by volatile compounds released from the aerosol-forming substrate passes over and is cooled by the aerosol-cooling element before being inhaled by a user. In contrast to high resistance to draw filters and other mouthpieces, aerosol-cooling elements have a low resistance to draw. Chambers and cavities within an aerosol-generating article are also not considered to be aerosol cooling elements.

Preferably, the aerosol-generating article is a smoking article that generates an aerosol that is directly inhalable into a user's lungs through the user's mouth. More, preferably, the aerosol-generating article is a smoking article that generates a nicotine-containing aerosol that is directly inhalable into a user's lungs through the user's mouth.

As used herein, the term 'aerosol-generating device' is used to describe a device that interacts with an aerosol-forming substrate of an aerosol-generating article to generate an aerosol. Preferably, the aerosol-generating device is a smoking device that interacts with an aerosol-forming substrate of an aerosol-generating article to generate an aerosol that is directly inhalable into a user's lungs thorough the user's mouth. The aerosol-generating device may be a holder for a smoking article.

For the avoidance of doubt, in the following description the term 'heating element' is used to mean one or more heating elements.

In preferred embodiments, the aerosol-forming substrate is located at the upstream end of the aerosol-generating article.

In alternative embodiments, the aerosol-generating article may comprise a front-plug upstream of the aerosol-forming substrate, wherein the front plug is penetrable by a heating element of an aerosol-generating device. In such alternative embodiments, the front-plug may be located at the upstream end of the aerosol-generating article.

In such embodiments, the front-plug may prevent egress of the aerosol-forming substrate from the upstream end of the aerosol-forming substrate during handling and shipping. The front-plug may also assist in positioning the aerosol-forming substrate at a predetermined distance from the upstream end of the aerosol-forming substrate for optimum engagement with a heating element of an aerosol-generating device.

The front-plug may be configured to prevent egress of the aerosol-forming substrate from the aerosol-generating article during use, for example as a heating element of the aerosol-generating device is withdrawn from the aerosol-generating article. The aerosol-forming substrate of the aerosol-generating article may shrink into contact with a heating element of the aerosol-generating device during heating of the aerosol-forming substrate to generate an aerosol. The aerosol-forming substrate may also shrink such that its contact with the outer wrapper circumscribing the components of the aerosol-generating article is reduced. This may loosen the aerosol-forming substrate within the aerosol-generating article. Inclusion of a front-plug may facilitate removal of a heating element from the aerosol-generating article by resisting upstream movement of the aerosol-forming substrate during withdrawal of a heating element of an aerosol-generating device from the aerosol-forming substrate of aerosol-generating article.

Alternatively or in addition, the front-plug may be configured to wipe a surface of the heating element of the aerosol-generating device as the heating element of the aerosol-generating device is withdrawn from the aerosol-generating article.

The front-plug may define a hole or slit through which a heating element of an aerosol-generating device can pass. In this case, in methods according to the second and fourth aspects the step of inserting a heating element of an aerosol-generating device into the aerosol-forming substrate of the aerosol-generating article may comprise passing the heating element of the aerosol-generating device through the hole or slit of the front plug of the aerosol-generating article.

The hole or slit defined in the front-plug may be dimensioned to engage with a heating element of an aerosol-generating device passed therethrough. For example, the dimensions of the hole or slit defined in the front-plug may almost exactly match the dimensions of a cross-section of the heating element of the aerosol-generating device. Alternatively, the hole or slit may have smaller dimensions than a cross-section of the heating element of the aerosol-generating device. In such embodiments, the heating element may need to deform the front-plug in order to pass through the hole or slit.

One or more holes or slits may be defined in the front-pug. For example, an aerosol-generating article intended to be used with an aerosol-generating device having three heating elements may comprise a front-plug with three holes or slits defined therein, each arranged to accept one of the three heating elements of the aerosol-generating device.

Alternatively, the front-plug may be formed of a pierceable material. In this case, in methods according to the second and fourth aspects the step of inserting a heating element of an aerosol-generating device into the aerosol-forming substrate of the aerosol-generating article may comprise piercing the front plug of the aerosol-generating article with the heating element of the aerosol-generating device.

The front-plug may be made from an air permeable material that allows air to be drawn through the front plug. In such embodiments, a user may draw air downstream through the aerosol-generating article through the front-plug.

The front-plug may be formed from an air permeable filter material. The front-plug may conveniently be formed from an air permeable material used to form mouthpiece filters for a conventional lit-end cigarette. For example, the front-plug may be formed from cellulose acetate tow. The permeability of the front-plug may be varied to help control resistance to draw of the aerosol-generating article.

Alternatively, the front-plug may be formed from an air impermeable material. In such embodiments, the aerosol-generating article may further comprise one or more air inlets downstream of the front plug through which air may be drawn into the aerosol-generating article.

The front-plug may be formed from a low strength material in order to reduce the force required to penetrate the front plug with a heating element of an aerosol-generating device.

The front plug may be formed from a fibrous material or a foam material. Where the front-plug is formed from a fibrous material, the fibres of the fibrous material may be substantially aligned along the longitudinal direction of the aerosol-generating article in order to reduce the force required to penetrate the front plug with a heating element of an aerosol-generating device.

In some embodiments, the front-plug may be at least partially formed from an aerosol-forming substrate. For example, the front-plug may be at least partially formed from an aerosol-forming substrate comprising tobacco.

As used herein, the term 'longitudinal' is used to describe the direction between the downstream end and the upstream end of the aerosol-generating article and the term 'transverse' is used to describe the direction perpendicular to the longitudinal direction.

The front-plug may be formed from a pierceable material that may be deformed by a heating element of an aerosol-generating device upon insertion of the heating element into the aerosol-generating article and that regains its shape when the heating element is withdrawn from the aerosol-generating article.

For example, the front-plug may be formed from a pierceable resilient material that deforms to allow a heating element of an aerosol-generating device to pass the front plug when the front plug is pierced by the heating element. When the heating element is withdrawn from the aerosol-generating article, the hole or slit pierced through the front-plug by the heating element may fully or partially close. In such embodiments, the front-plug may advantageously provide a cleaning function by wiping the heating element of the aerosol-generating device as the heating element is withdrawn from the aerosol-generating article.

However, it will be appreciated that the front-plug does not need to be formed from a resilient material in order to provide a cleaning function. For example, a cleaning function may also be provided on withdrawal of a heating element of an aerosol-generating device from the aerosol-generating article where the front plug defines a hole or slit having dimensions that almost exactly match or are smaller than the dimensions of a cross-section of the heating element.

The front-plug preferably has an external diameter that is approximately equal to the external diameter of the aerosol-generating article.

Preferably, the front-plug has an external diameter of at least 5 millimetres. The front-plug substrate may have an external diameter of between approximately 5 millimetres and approximately 12 millimetres, for example of between approximately 5 millimetres and approximately 10 millimetres or of between approximately 6 millimetres and approximately 8 millimetres. In a preferred embodiment, the front-plug has an external diameter of 7.2 millimetres+/−10%.

Preferably the front plug has a length of at least 2 millimetres, more preferably at least 3 millimetres or at least 4 millimetres. The front-plug may have a length of between approximately 2 millimetres and approximately 10 mm, for example of between approximately 4 millimetres and approximately 8 mm.

As used herein, the term 'diameter' is used to describe the maximum dimension in the transverse direction of the aerosol-generating article. As used herein, the term 'length' is used to describe the maximum dimension in the longitudinal direction of the aerosol-generating article.

Preferably, the front-plug is substantially cylindrical.

Preferably, the aerosol-forming substrate is a solid aerosol-forming substrate. The aerosol-forming substrate may comprise both solid and liquid components.

Preferably, the aerosol-forming substrate comprises nicotine. More preferably, the aerosol-forming substrate comprises tobacco.

Alternatively or in addition, the aerosol-forming substrate may comprise a non-tobacco containing aerosol-forming material.

If the aerosol-forming substrate is a solid aerosol-forming substrate, the solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

Optionally, the solid aerosol-forming substrate may contain tobacco or non-tobacco volatile flavour compounds, which are released upon heating of the solid aerosol-forming substrate. The solid aerosol-forming substrate may also contain one or more capsules that, for example, include additional tobacco volatile flavour compounds or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

In a preferred embodiment, the aerosol-forming substrate comprises homogenised tobacco material.

As used herein, the term 'homogenised tobacco material' denotes a material formed by agglomerating particulate tobacco.

Preferably, the aerosol-forming substrate comprises a gathered sheet of homogenised tobacco material.

As used herein, the term 'sheet' denotes a laminar element having a width and length substantially greater than the thickness thereof.

As used herein, the term 'gathered' is used to describe a sheet that is convoluted, folded, or otherwise compressed or constricted substantially transversely to the longitudinal axis of the aerosol-generating article.

Use of an aerosol-forming substrate comprising a gathered sheet of homogenised tobacco material advantageously significantly reduces the risk of 'loose ends' compared to an aerosol-forming substrate comprising shreds of tobacco material, that is the loss of shreds of tobacco material from the ends of the rod. Loose ends may disadvantageously lead to the need for more frequent cleaning of an aerosol-generating device for use with the aerosol-generating article and manufacturing equipment.

Aerosol-forming substrates comprising a gathered sheet of homogenised tobacco material also advantageously exhibit significantly lower weight standard deviations than aerosol-forming substrate comprising shreds of tobacco material. The weight of an aerosol-forming substrate comprising a gathered sheet of homogenised tobacco material of a particular length is determined by the density, width and thickness of the sheet of homogenised tobacco material that is gathered to form the aerosol-forming substrate. The weight of aerosol-forming substrates comprising a gathered sheet of homogenised tobacco material of a particular length can thus be regulated by controlling the density and dimensions of the sheet of homogenised tobacco material. This reduces inconsistencies in weight between aerosol-forming substrates of the same dimensions, and so results in lower rejection rate of aerosol-forming substrates whose weight falls outside of a selected acceptance range compared to aerosol-forming substrate comprising shreds of tobacco material.

Aerosol-forming substrates comprising a gathered sheet of homogenised tobacco material also advantageously exhibit more uniform densities than aerosol-forming substrates comprising shreds of tobacco material.

Insertion of a heating element of an aerosol-generating device into an aerosol-generating substrate comprising shreds of tobacco material and withdrawal of a heating element of an aerosol-generating device into an aerosol-generating substrate comprising shreds of tobacco material may tend to dislodge shreds of tobacco material from the aerosol-generating substrate. This can disadvantageously result in the need for more frequent cleaning of the heating element and other parts of the aerosol-generating device in order to remove the dislodged shreds.

In contrast, Insertion of a heating element of an aerosol-generating device into an aerosol-generating substrate comprising a gathered sheet of homogenised tobacco material and withdrawal of a heating element of an aerosol-generating device into an aerosol-generating substrate comprising a gathered sheet of homogenised tobacco material advantageously does not tend to dislodge tobacco material.

In a preferred embodiment, the aerosol-forming substrate comprises a gathered textured sheet of homogenised tobacco material.

As used herein, the term 'textured sheet' denotes a sheet that has been crimped, embossed, debossed, perforated or otherwise deformed. The aerosol-forming substrate may comprise a gathered textured sheet of homogenised tobacco material comprising a plurality of spaced-apart indentations, protrusions, perforations or a combination thereof.

In a particularly preferred embodiment, the aerosol-forming substrate comprises a gathered crimpled sheet of homogenised tobacco material.

Use of a textured sheet of homogenised tobacco material may advantageously facilitate gathering of the sheet of homogenised tobacco material to form the aerosol-forming substrate.

As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled.

In certain embodiments, the aerosol-forming substrate may comprise a gathered sheet of homogenised tobacco material that is substantially evenly textured over substantially its entire surface. For example, the aerosol-forming substrate may comprise a gathered crimped sheet of homogenised tobacco material comprising a plurality of substantially parallel ridges or corrugations that are substantially evenly spaced-apart across the width of the sheet.

The aerosol-forming substrate may be in the form of a plug comprising an aerosol-forming material circumscribed by a paper or other wrapper. Where an aerosol-forming substrate is in the form of a plug, the entire plug including any wrapper is considered to be the aerosol-forming substrate.

In a preferred embodiment, the aerosol-generating substrate comprises a plug comprising a gathered textured sheet of homogenised tobacco material circumscribed by a wrapper. In a particularly preferred embodiment, the aerosol-generating substrate comprises a plug comprising a gathered crimped sheet of homogenised tobacco material circumscribed by a wrapper.

In certain embodiments, sheets of homogenised tobacco material for use in the aerosol-generating substrate may have a tobacco content of approximately 70% or more by weight on a dry weight basis.

Sheets of homogenised tobacco material for use in the aerosol-generating substrate may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material for use in the aerosol-generating substrate may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets of homogenised tobacco material for use in the aerosol-generating substrate are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets of homogenised tobacco material for use in the aerosol-generating substrate are known in the art and include, but are not limited to: cellulose fibers; soft-wood fibres; hard-wood fibres; jute fibres and combinations thereof. Prior to inclusion in sheets of homogenised tobacco material for use in the aerosol-generating substrate, non-tobacco fibres may be treated by suitable processes known in the art including, but not limited to: mechanical pulping; refining; chemical pulping; bleaching; sulfate pulping; and combinations thereof.

Sheets of homogenised tobacco material for use in the aerosol-generating substrate should have sufficiently high tensile strength to survive being gathered to form the aerosol-generating substrate. In certain embodiments non-tobacco fibres may be included in sheets of homogenised tobacco material for use in the aerosol-generating substrate in order to achieve an appropriate tensile strength.

For example, homogenised sheets of tobacco material for use in the aerosol-generating substrate may comprise between approximately 1% and approximately 5% non-tobacco fibres by weight on a dry weight basis.

Preferably, the aerosol-forming substrate comprises an aerosol former.

As used herein, the term 'aerosol former' is used to describe any suitable known compound or mixture of compounds that, in use, facilitates formation of an aerosol and tht is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate Preferred aerosol formers are polyhydric alcohols or mixtures thereof, such as propylene glycol, triethylene glycol, 1,3-butanediol and, most preferred, glycerine.

The aerosol-forming substrate may comprise a single aerosol former. Alternatively, the aerosol-forming substrate may comprise a combination of two or more aerosol formers.

Preferably, the aerosol-forming substrate has an aerosol former content of greater than 5% on a dry weight basis.

The aerosol aerosol-forming substrate may have an aerosol former content of between approximately 5% and approximately 30% on a dry weight basis.

In a preferred embodiment, the aerosol-forming substrate has an aerosol former content of approximately 20% on a dry weight basis.

Aerosol-forming substrates comprising gathered sheets of homogenised tobacco for use in the aerosol-generating article may be made by methods known in the art, for example the methods disclosed in WO 2012/164009 A2.

In a preferred embodiment sheets of homogenised tobacco material for use in the aerosol-generating article are formed from a slurry comprising particulate tobacco, guar gum, cellulose fibres and glycerine by a casting process.

The aerosol-forming element preferably has an external diameter that is approximately equal to the external diameter of the aerosol-generating article.

Preferably, the aerosol-forming substrate has an external diameter of at least 5 millimetres. The aerosol-forming substrate may have an external diameter of between approximately 5 millimetres and approximately 12 millimetres, for example of between approximately 5 millimetres and approximately 10 millimetres or of between approximately 6 millimetres and approximately 8 millimetres. In a preferred embodiment, the aerosol-forming substrate has an external diameter of 7.2 millimetres+/−10%.

The aerosol-forming substrate may have a length of between approximately 7 millimetres and approximately 15 mm. In one embodiment, the aerosol-forming substrate may have a length of approximately 10 millimetres. In a preferred embodiment, the aerosol-forming substrate has a length of approximately 12 millimetres.

Preferably, the aerosol-forming substrate is substantially cylindrical.

The support element is located immediately downstream of the aerosol-forming substrate and abuts the aerosol-forming substrate.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate.

The support element may comprise a hollow tubular element. In a preferred embodiment, the support element comprises a hollow cellulose acetate tube.

The support element preferably has an external diameter that is approximately equal to the external diameter of the aerosol-generating article.

The support element may have an external diameter of between approximately 5 millimetres and approximately 12 millimetres, for example of between approximately 5 millimetres and approximately 10 millimetres or of between approximately 6 millimetres and approximately 8 millimetres. In a preferred embodiment, the support element has an external diameter of 7.2 millimetres+/−10%.

The support element may have a length of between approximately 5 millimetres and approximately 15 mm. In a preferred embodiment, the support element has a length of approximately 8 millimetres.

During insertion of a heating element of an aerosol-generating device into an aerosol-forming substrate of an aerosol-generating article, a user may be required to apply some force in order to overcome the resistance of the aerosol-forming substrate of the aerosol-generating article to insertion of the heating element of the aerosol-generating device. This may damage one or both of the aerosol-generating article and the heating element of the aerosol-generating device.

In addition, the application of force during insertion of the heating element of the aerosol-generating device into the aerosol-forming substrate of the aerosol-generating article may displace the aerosol-forming substrate within the aerosol-generating article. This may result in the heating element of the aerosol-generating device not being fully inserted into the aerosol-forming substrate, which may lead to uneven and inefficient heating of the aerosol-forming substrate of the aerosol-generating article.

In preferred embodiments, the support element is configured to resist downstream movement of the aerosol-forming substrate during insertion of the heating element of the aerosol-generating device into the aerosol-forming substrate of aerosol-generating article.

The insertion force experienced by the aerosol-generating article as it is inserted into the aerosol-generating device by a user may be divided into three parts: friction force, penetration force and crush force.

As the aerosol-generating article is initially inserted into the aerosol-generating device and prior to the heating element of the aerosol-generating device being inserted into the aerosol-forming substrate of the aerosol-generating article, the insertion force is dominated by the force required to overcome friction due to interference between the exterior surface of the aerosol-generating article and the interior surface of the aerosol-generating device. As used herein, the term 'friction force' is used to describe the maximum insertion force prior to insertion of the heating element of the aerosol-generating device into the aerosol-forming substrate of the aerosol-generating article.

As the aerosol-generating article is inserted further into the aerosol-generating device and prior to the aerosol-generating article reaching a position of maximum insertion, the insertion force is dominated by the force required to overcome resistance of the aerosol-forming substrate of the aerosol-generating article to insertion of the heating element of the aerosol-generating device.

As used herein, the term 'penetration force' is used to describe the maximum insertion force during insertion of the heating element into the aerosol-forming substrate of the aerosol-generating article and prior to the aerosol-generating article reaching a position of maximum insertion.

Once the aerosol-generating article reaches a point of maximum insertion, the insertion force is dominated by the force required to deform the aerosol-generating article. At the position of maximum insertion, the extreme upstream end of the aerosol-generating article may come into contact with a surface, for example a bottom or rear surface, of the aerosol-generating device, which prevents the aerosol-generating article from being inserted further into the aerosol-generating device.

As used herein, the term 'crush force' is used to describe the maximum insertion force after the aerosol-generating article reaches a point of maximum insertion.

The support element of the aerosol-generating article resists the penetration force experienced by the aerosol-generating article during insertion of a heating element of an aerosol-generating device into the aerosol-forming substrate.

In one embodiment, the support element is configured to resist a penetration force of at least 2.5 N during insertion of a heating element of an aerosol-generating device into the aerosol-forming substrate.

In another embodiment, the support element is configured to resist a penetration force of at least 4 N during insertion of a heating element of an aerosol-generating device into the aerosol-forming substrate.

The support element of the aerosol-generating article resists downstream movement of the aerosol-forming substrate within the aerosol-generating article during insertion of a heating element of an aerosol-generating device into the aerosol-forming substrate.

This may help to ensure that the heating element of the aerosol-generating device is fully inserted into the aerosol-forming substrate and so avoid uneven and inefficient heating of the aerosol-forming substrate of the aerosol-generating article.

Preferably, the support element has a fracture force of at least 40 N, for example at least 45 N or at least 50 N as measured using a standard compression test.

The aerosol-cooling element may be located immediately downstream of the support element and abut the support element.

The aerosol-cooling element may be located between the support element and a mouthpiece located at the extreme downstream end of the aerosol-generating article.

The aerosol-cooling element may have a total surface area of between approximately 300 square millimetres per millimetre length and approximately 1000 square millimetres per millimetre length. In a preferred embodiment, the aerosol-cooling element has a total surface area of approximately 500 square millimetres per millimetre length.

The aerosol-cooling element may be alternatively termed a heat exchanger.

The aerosol-cooling element preferably has a low resistance to draw. That is, the aerosol-cooling element preferably offers a low resistance to the passage of air through the aerosol-generating article. Preferably, the aerosol-cooling element does not substantially affect the resistance to draw of the aerosol-generating article.

Preferably, the aerosol-cooling element has a porosity of between 50% and 90% in the longitudinal direction. The porosity of the aerosol-cooling element in the longitudinal direction is defined by the ratio of the cross-sectional area of material forming the aerosol-cooling element and the internal cross-sectional area of the aerosol-generating article at the position of the aerosol-cooling element.

The aerosol-cooling element may alternatively be referred to as a heat exchanger.

The aerosol-cooling element may comprise a plurality of longitudinally extending channels. The plurality of longitudinally extending channels may be defined by a sheet material that has been one or more of crimped, pleated, gathered and folded to form the channels. The plurality of longitudinally extending channels may be defined by a single sheet that has been one or more of crimped, pleated, gathered and folded to form multiple channels. Alternatively, the plurality of longitudinally extending channels may be defined by multiple sheets that have been one or more of crimped, pleated, gathered and folded to form multiple channels.

It is preferred that airflow through the aerosol-cooling element does not deviate to a substantive extent between adjacent channels. In other words, it is preferred that the airflow through the aerosol-cooling element is in a longitudinal direction along a longitudinal channel, without substantive radial deviation. In some embodiments, the aerosol-cooling element is formed from a material that has a low porosity, or substantially no-porosity other than the longitudinally extending channels. For example, the aerosol-cooling element may be formed from a sheet material having low porosity or substantially no porosity that has been one or more of crimped, pleated, gathered and folded to form the channels.

In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In a preferred embodiment, the aerosol-cooling element comprises a gathered sheet of biodegradable material. For example, a gathered sheet of non-porous paper or a gathered sheet of biodegradable polymeric material, such as polylactic acid or a grade of Mater-Bi® (a commercially available family of starch based copolyesters).

In a particularly preferred embodiment, the aerosol-cooling element comprises a gathered sheet of polylactic acid.

The aerosol-cooling element may be formed from a gathered sheet of material having a specific surface area of between approximately 10 square millimetres per milligram and approximately 100 square millimetres per milligram weight. In some embodiments, the aerosol-cooling element may be formed from a gathered sheet of material having a specific surface area of approximately 35 $mm^2/mg$.

When an aerosol that contains a proportion of water vapour is drawn through the aerosol-cooling element, some of the water vapour may condense on a surface of the aerosol-cooling element. In such cases, it is preferred that the condensed water remains in droplet form on the surface of the aerosol-cooling element rather than being absorbed into the aerosol-cooling element. Thus, it is preferred that the aerosol-cooling element is formed from material that is substantially non-porous or substantially non-absorbent to water.

The aerosol-cooling element may act to cool the temperature of a stream of aerosol drawn through the aerosol-cooling element by means of thermal transfer. Components of the aerosol will interact with the aerosol-cooling element and loose thermal energy.

The aerosol-cooling element may act to cool the temperature of a stream of aerosol drawn through the aerosol-cooling element by undergoing a phase transformation that consumes heat energy from the aerosol stream. For example, the aerosol-cooling element may be formed from a material that undergoes an endothermic phase transformation such as melting or a glass transition.

The aerosol-cooling element may act to lower the temperature of a stream of aerosol drawn through the aerosol-cooling element by causing condensation of components such as water vapour from the aerosol stream. Due to condensation, the aerosol stream may be drier after passing through the aerosol-cooling element. In some embodiments, the water vapour content of an aerosol stream drawn through the aerosol-cooling element may be lowered by between approximately 20% and approximately 90%. The user may perceive the temperature of a drier aerosol to be lower than the temperature of a moister aerosol of the same actual temperature.

In some embodiments, the temperature of an aerosol stream may be lowered by more than 10 degrees Celsius as it is drawn through the aerosol-cooling element. In some embodiments, the temperature of an aerosol stream may be lowered by more than 15 degrees Celsius or more than 20 degrees Celsius as it is drawn through the aerosol-cooling element.

In some embodiments, the aerosol-cooling element removes a proportion of the water vapour content of an aerosol drawn through the aerosol-cooling element. In some embodiments, a proportion of other volatile substances may be removed from the aerosol stream as the aerosol is drawn through the aerosol-cooling element. For example, in some embodiments a proportion of phenolic compounds may be removed from the aerosol stream as the aerosol is drawn through the aerosol-cooling element.

Phenolic compounds may be removed by interaction with the material forming the aerosol-cooling element. For example, the aerosol-cooling element may be formed from a material that adsorbs the phenolic compounds (for example phenols and cresols).

Phenolic compounds may be removed by interaction with water droplets condensed on the surface of the aerosol-cooling element.

As noted above, the aerosol-cooling element may be formed from a sheet of suitable material that has been one or more of crimped, pleated, gathered or folded to define a plurality of longitudinally extending channels. A cross-sectional profile of such an aerosol-cooling element may show the channels as being randomly oriented. The aerosol-cooling element may be formed by other means. For example, the aerosol-cooling element may be formed from a bundle of longitudinally extending tubes. The aerosol-cooling element may be formed by extrusion, molding, lamination, injection, or shredding of a suitable material.

The aerosol-cooling element may comprise an outer tube or wrapper that contains or locates the longitudinally extending channels. For example, a pleated, gathered, or folded sheet material may be wrapped in a wrapper material, for example a plug wrapper, to form the aerosol-cooling element. In some embodiments, the aerosol-cooling element comprises a sheet of crimped material that is gathered into a rod-shape and bound by a wrapper, for example a wrapper of filter paper.

The aerosol-cooling element preferably has an external diameter that is approximately equal to the external diameter of the aerosol-generating article.

The aerosol-cooling element may have an external diameter of a diameter of between approximately 5 millimetres and approximately 10 millimetres, for example of between approximately 6 millimetres and approximately 8 millimetres. In a preferred embodiment, the aerosol-cooling element has an external diameter of 7.2 millimetres+/−10%.

The aerosol-cooling element may have a length of between approximately 5 millimetres and approximately 25 mm. In a preferred embodiment, the aerosol-cooling element has a length of approximately 18 millimetres.

In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In a preferred embodiment, the aerosol-cooling element comprises a gathered sheet of biodegradable polymeric material, such as polylactic acid or a grade of Mater-Bi® (a commercially available family of starch based copolyesters).

In a particularly preferred embodiment, the aerosol-cooling element comprises a gathered sheet of polylactic acid.

The aerosol-generating article may comprise a volatile flavour-generating component located in the aerosol-cooling element. For example, the aerosol-generating article may comprise a volatile flavour-generating component located in a longitudinally extending channel of the aerosol-cooling element.

As used herein the term 'volatile flavour component' is used to describe any volatile component that is added to an aerosol-generating article in order to provide a flavour.

The volatile flavour-generating component may be in the form of a liquid or a solid. The volatile flavour-generating compound may be coupled to, or otherwise associated with, a support element. The volatile flavour-generating component may comprise menthol.

As used herein, the term 'menthol' is used to describe the compound 2-isopropyl-5-methylcyclohexanol in any of its isomeric forms.

Menthol may be used in solid or liquid form. In solid form, menthol may be provided as particles or granules. The term 'solid menthol particles' may be used to describe any granular or particulate solid material comprising at least approximately 80% menthol by weight.

Preferably, 1.5 mg or more of the volatile flavour generating component is included in the aerosol-generating article.

The volatile flavour-generating component may be coupled to a fibrous support element. The fibrous support element may be any suitable substrate or support for locating, holding, or retaining the flavour-generating component. The fibrous support element may be, for example, a paper support. Such a paper support may be saturated with a liquid component such as liquid menthol. The fibrous support may be, for example, a thread or twine. Such a thread or twine may be saturated in a liquid component such as liquid menthol. Alternatively, such a thread or twine may be threaded to or otherwise coupled to a solid flavour generating component. For example, solid particles of menthol may be coupled to a thread.

Preferably the volatile flavour-generating component is supported by an elongate fibrous support element, such as a thread or twine. Preferably, the volatile flavour-generating component is disposed radially inward from an inner surface of the outer wrapper within the aerosol-generating article with the longitudinal axis of the elongate fibrous support element disposed substantially parallel to the longitudinal axis of the aerosol-generating article.

The aerosol-generating article may comprise a mouthpiece located at the downstream end of the aerosol-generating article.

The mouthpiece may be located immediately downstream of the aerosol-cooling element and abut the aerosol-cooling element.

The mouthpiece may comprise a filter. The filter may be formed from one or more suitable filtration materials. Many such filtration materials are known in the art. In one embodiment, the mouthpiece may comprise a filter formed from cellulose acetate tow.

The mouthpiece preferably has an external diameter that is approximately equal to the external diameter of the aerosol-generating article.

The mouthpiece may have an external diameter of a diameter of between approximately 5 millimetres and approximately 10 millimetres, for example of between approximately 6 millimetres and approximately 8 millimetres. In a preferred embodiment, the mouthpiece has an external diameter of 7.2 millimetres+/−10%.

The mouthpiece may have a length of between approximately 5 millimetres and approximately 20 millimetres. In a preferred embodiment, the mouthpiece has a length of approximately 14 millimetres.

The mouthpiece may have a length of between approximately 5 millimetres and approximately 14 millimetres. In a preferred embodiment, the mouthpiece has a length of approximately 7 millimetres.

The aerosol-forming substrate, the support element and the aerosol-cooling element and any other elements of the aerosol-generating article, such as the front-plug and mouthpiece where present, are circumscribed by an outer wrapper. The outer wrapper may be formed from any suitable material or combination of materials.

Preferably, the outer wrapper is a cigarette paper.

A downstream end portion of the outer wrapper may be circumscribed by a band of tipping paper.

The appearance of the aerosol-generating article may simulate the appearance of a conventional lit-end cigarette.

The aerosol-generating article may have an external diameter of between approximately 5 millimetres and approximately 12 millimetres, for example of between approximately 6 millimetres and approximately 8 millimetres. In a preferred embodiment, the aerosol-generating article has an external diameter of 7.2 millimetres+/−10%.

The aerosol-generating article may have a total length of between approximately 30 millimetres and approximately 100 millimetres. In a preferred embodiment, the aerosol-generating article has a total length of approximately 45 millimetres.

The aerosol-generating device may comprise: a housing; a heating element; an electrical power supply connected to the heating element; and a control element configured to control the supply of power from the power supply to the heating element.

The housing may define a cavity surrounding the heating element, the cavity configured to receive the aerosol-generating article.

Preferably, the aerosol-generating device is a portable or handheld aerosol-generating device that is comfortable for a user to hold between the fingers of a single hand.

The aerosol-generating device may be substantially cylindrical in shape

The aerosol-generating device may have a length of between approximately 70 millimetres and approximately 120 millimetres.

The device may include other heaters in addition to the internal heating element that is inserted into the aerosol-forming substrate of the aerosol-generating article.

The power supply may be any suitable power supply, for example a DC voltage source such as a battery. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery.

The control element may be a simple switch. Alternatively the control element may be electric circuitry and may comprise one or more microprocessors or microcontrollers.

The aerosol-generating system may comprise an aerosol-generating device and one or more aerosol-generating articles configured to be received in the cavity of the aerosol-generating device.

The heating element of the aerosol-generating device may be any suitable heating element capable of being inserted into the aerosol-forming substrate of the aerosol-generating article. For example, the heating element may be in the form of a pin or blade.

The heating element may have a tapered, pointed or sharpened end to facilitate insertion of the heating element into the aerosol-forming substrate of the aerosol-generating article.

The resistance to draw (RTD) of the aerosol-generating article after insertion of the heating element may be between approximately 80 mm WG and approximately 140 mm WG.

As used herein, resistance to draw is expressed with the units of pressure 'mm WG' or 'mm of water gauge' and is measured in accordance with ISO 6565:2002.

Features described in relation to one aspect or embodiment may also be applicable to other aspects and embodiments. For example, features described in relation to aerosol-generating articles and aerosol-generating systems described above may also be used in conjunction with methods of using aerosol-generating articles and aerosol-generating systems described above.

FIG. 1 illustrates an aerosol-generating article 10 according to a preferred embodiment. The aerosol-generating article 10 comprises four elements arranged in coaxial alignment: an aerosol-forming substrate 20, a support element 30, an aerosol-cooling element 40, and a mouthpiece 50. These four elements are arranged sequentially and are circumscribed by an outer wrapper 60 to form the aerosol-generating article 10. The aerosol-generating 10 has a proximal or mouth end 70, which a user inserts into his or her mouth during use, and a distal end 80 located at the opposite end of the aerosol-generating article 10 to the mouth end 70.

In use air is drawn through the aerosol-generating article by a user from the distal end 80 to the mouth end 70. The distal end 80 of the aerosol-generating article may also be described as the upstream end of the aerosol-generating article 10 and the mouth end 70 of the aerosol-generating article 10 may also be described as the downstream end of the aerosol-generating article 10. Elements of the aerosol-generating article 10 located between the mouth end 70 and the distal end 80 can be described as being upstream of the mouth end 70 or, alternatively, downstream of the distal end 80.

The aerosol-forming substrate 20 is located at the extreme distal or upstream end of the aerosol-generating article 10. In the embodiment illustrated in FIG. 1, aerosol-forming substrate 20 comprises a gathered sheet of crimped homogenised tobacco material circumscribed by a wrapper. The crimped sheet of homogenised tobacco material comprises comprising glycerine as an aerosol-former.

The support element 30 is located immediately downstream of the aerosol-forming substrate 20 and abuts the aerosol-forming substrate 20. In the embodiment shown in FIG. 1, the support element is a hollow cellulose acetate tube. The support element 30 locates the aerosol-forming substrate 20 at the extreme distal end 80 of the aerosol-generating article 10 so that it can be penetrated by a heating element of an aerosol-generating device. As described further below, the support element 30 acts to prevent the aerosol-forming substrate 20 from being forced downstream within the aerosol-generating article 10 towards the aerosol-cooling element 40 when a heating element of an aerosol-generating device is inserted into the aerosol-forming substrate 20. The support element 30 also acts as a spacer to space the aerosol-cooling element 40 of the aerosol-generating article 10 from the aerosol-forming substrate 20.

The aerosol-cooling element 40 is located immediately downstream of the support element 30 and abuts the support element 30. In use, volatile substances released from the aerosol-forming substrate 20 pass along the aerosol-cooling element 40 towards the mouth end 70 of the aerosol-generating article 10. The volatile substances may cool within the aerosol-cooling element 40 to form an aerosol that is inhaled by the user. In the embodiment illustrated in FIG. 1, the aerosol-cooling element comprises a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the aerosol-cooling element 40 and abuts the aerosol-cooling element 40. In the embodiment illustrated in FIG. 1, the mouthpiece 50 comprises a conventional cellulose acetate tow filter of low filtration efficiency.

To assemble the aerosol-generating article 10, the four elements described above are aligned and tightly wrapped within the outer wrapper 60. In the embodiment illustrated in FIG. 1, the outer wrapper is a conventional cigarette paper. As shown in FIG. 1, an optional row of perforations is provided in a region of the outer wrapper 60 circumscribing the support element 30 of the aerosol-generating article 10.

In the embodiment illustrated in FIG. 1, a distal end portion of the outer wrapper 60 of the aerosol-generating article 10 is circumscribed by a band of tipping paper (not shown).

The aerosol-generating article 10 illustrated in FIG. 1 is designed to engage with an aerosol-generating device comprising a heating element in order to be smoked or consumed by a user. In use, the heating element of the aerosol-generating device heats the aerosol-forming substrate 20 of the aerosol-generating article 10 to a sufficient temperature to form an aerosol, which is drawn downstream through the aerosol-generating article 10 and inhaled by the user.

Figure 2:
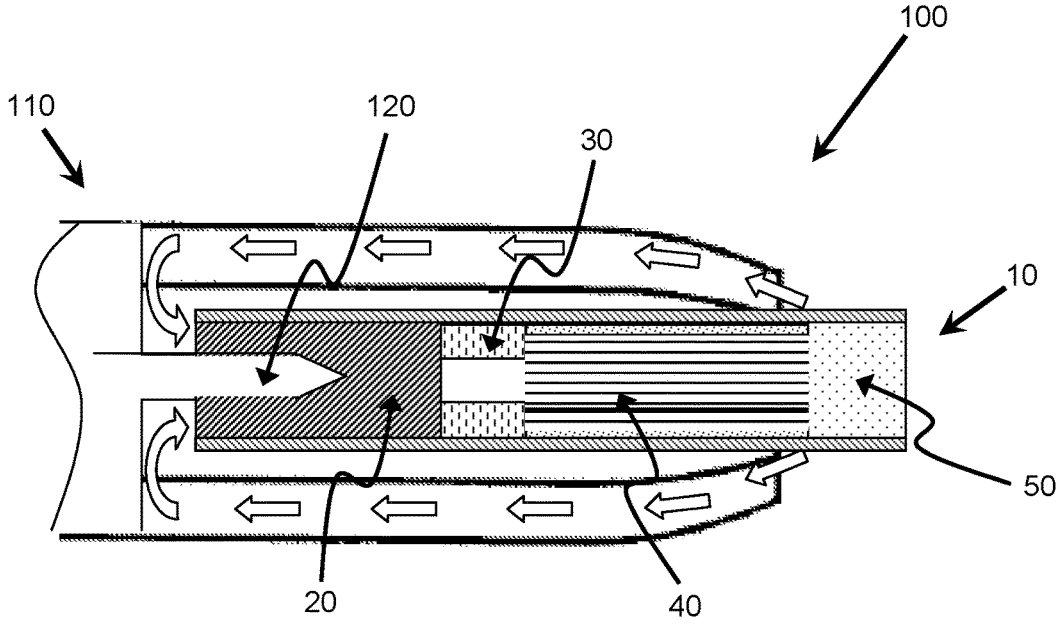
FIG. 2 is a schematic cross-sectional diagram of an embodiment of an aerosol-generating system comprising an electrically heated aerosol-generating device comprising a heating element and an aerosol-generating article according to the embodiment illustrated in FIG. 1.

FIG. 2 illustrates a portion of an aerosol-generating system 100 comprising an aerosol-generating device 110 and an aerosol-generating article 10 according to the embodiment described above and illustrated in FIG. 1.

The aerosol-generating device comprises a heating element 120. As shown in FIG. 2, the heating element 120 is mounted within an aerosol-generating article receiving chamber of the aerosol-generating device 110. In use, the user inserts the aerosol-generating article 10 into the aerosol-generating article receiving chamber of the aerosol-generating device 110 such that the heating element 120 is directly inserted into the aerosol-forming substrate 20 of the aerosol-generating article 10 as shown in FIG. 2. In the embodiment shown in FIG. 2, the heating element 120 of the aerosol-generating device 110 is a heater blade.

The aerosol-generating device 110 comprises a power supply and electronics (shown in FIG. 3) that allow the heating element 120 to be actuated. Such actuation may be manually operated or may occur automatically in response to a user drawing on an aerosol-generating article 10 inserted into the aerosol-generating article receiving chamber of the aerosol-generating device 110. A plurality of openings is provided in the aerosol-generating device to allow air to flow to the aerosol-generating article 10; the direction of air flow is illustrated by arrows in FIG. 2.

The support element 40 of the aerosol-generating article 10 resists the penetration force experienced by the aerosol-generating article 10 during insertion of the heating element 120 of the aerosol-generating device 110 into the aerosol-forming substrate 20. The support element 40 of the aerosol-generating article 10 thereby resists downstream movement of the aerosol-forming substrate within the aerosol-generating article 10 during insertion of the heating element of the aerosol-generating device into the aerosol-forming substrate.

Once the internal heating element 120 is inserted into the aerosol-forming substrate 10 actuated of the aerosol-generating article 10 and actuated, the aerosol-forming substrate 20 of the aerosol-generating article 10 is heated to a temperature of approximately 375 degrees Celsius by the heating element 120 of the aerosol-generating device 110. At this temperature, volatile compounds are evolved from the aerosol-forming substrate 20 of the aerosol-generating article 10. As a user draws on the mouth end 70 of the aerosol-generating article 10, the volatile compounds evolved from the aerosol-forming substrate 20 are drawn downstream through the aerosol-generating article 10 and condense to form an aerosol that is drawn through the mouthpiece 50 of the aerosol-generating article 10 into the user's mouth.

As the aerosol passes downstream thorough the aerosol-cooling element 40, the temperature of the aerosol is reduced due to transfer of thermal energy from the aerosol to the aerosol-cooling element 40. When the aerosol enters the aerosol-cooling element 40, its temperature is approximately 60 degrees Celsius. Due to cooling within the aerosol-cooling element 40, the temperature of the aerosol as it exits the aerosol-cooling element is approximately 40 degrees Celsius.

Figure 3:
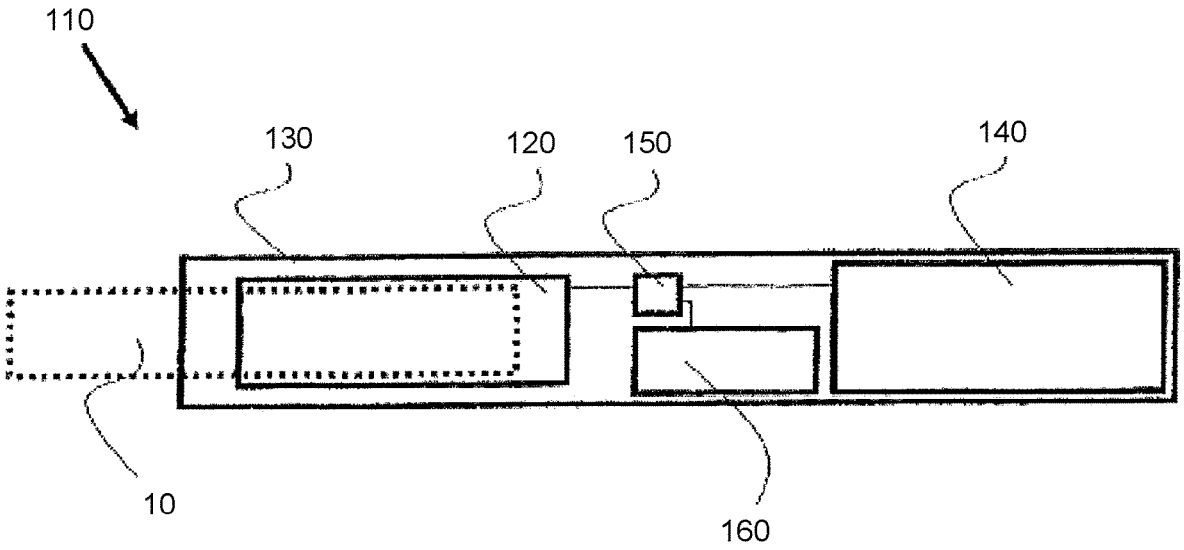
FIG. 3 is a schematic cross-sectional diagram of the electrically heated aerosol generating device illustrated in FIG. 2.

In FIG. 3, the components of the aerosol-generating device 110 are shown in a simplified manner. Particularly, the components of the aerosol-generating device 110 are not drawn to scale in FIG. 1. Components that are not relevant for the understanding of the embodiment have been omitted to simplify FIG. 3.

As shown in FIG. 3, the aerosol-generating device 110 comprises a housing 130. The heating element 120 is mounted within an aerosol-generating article receiving chamber within the housing 130. The aerosol-generating article 10 (shown by dashed lines in FIG. 3) is inserted into the aerosol-generating article receiving chamber within the housing 130 of the aerosol-generating device 110 such that the heating element 120 is directly inserted into the aerosol-forming substrate 20 of the aerosol-generating article 10.

Within the housing 130 there is an electrical energy supply 140, for example a rechargeable lithium ion battery. A controller 150 is connected to the heating element 120, the electrical energy supply 140, and a user interface 160, for example a button or display. The controller 150 controls the power supplied to the heating element 120 in order to regulate its temperature.

Although the support element of the aerosol-generating article according to the embodiment described above and illustrated in FIG. 1 is formed from cellulose acetate, it will be appreciated that this is not essential and that aerosol-generating articles according to other embodiments may comprise support elements formed from other suitable materials or combination of materials.

Similarly, although the aerosol-generating article according to the embodiment described above and illustrated in FIG. 1 comprises an aerosol-cooling element comprising a crimped and gathered sheet of polylactic acid, it will be appreciated that this is not essential and that aerosol-generating articles according to other embodiments may comprise other aerosol-cooling elements.

Furthermore, although the aerosol-generating article according to the embodiment described above and illustrated in FIG. 1 has four elements circumscribed by an outer wrapper, it will be appreciated than this is not essential and that aerosol-generating articles according to other embodiments may comprise additional elements or fewer elements.

It will also be appreciated that while the four elements of the aerosol-generating article according to the embodiment described above and illustrated in FIG. 1 are circumscribed by an outer wrapper of conventional cigarette paper, this is not essential and that the elements of aerosol-generating articles according to other embodiments may be circumscribed by other outer wrappers.

It will further be appreciated that dimensions provided for elements of the aerosol-generating article according to the embodiment described above and illustrated in FIG. 1 and parts of the aerosol-generating device according to the embodiment described above and illustrated in FIG. 2 are merely exemplary, and that suitable alternative dimensions may be chosen.

The exemplary embodiments described above are not limiting. Other embodiments consistent with the exemplary embodiments described above will be apparent to those skilled in the art.

The invention claimed is:

1. An aerosol-generating article for an aerosol-generating device comprising a heating element, the aerosol-generating article comprising:

an aerosol-forming substrate comprising homogenised tobacco material;

a support element disposed immediately downstream of the aerosol-forming substrate;

an aerosol-cooling element disposed downstream of the support element; and an outer wrapper circumscribing the aerosol-forming substrate, the support element, and the aerosol-cooling element, wherein the support element abuts the aerosol-forming substrate.

2. The aerosol-generating article according to claim 1, wherein the aerosol-forming substrate is penetrable by the heating element of the aerosol-generating device.

3. The aerosol-generating article according to claim 1, further comprising a front plug upstream of the aerosol-forming substrate, wherein the front plug is penetrable by the heating element of the aerosol-generating device, and wherein the outer wrapper circumscribes the aerosol-forming substrate, the support element, the aerosol-cooling element, and the front plug.

4. The aerosol-generating article according to claim 1, wherein the support element is configured to resist a penetration force of at least 2.5 Newtons during insertion of the heating element of the aerosol-generating device into the aerosol-forming substrate.

5. The aerosol-generating article according to claim 1, wherein the aerosol-forming substrate is disposed at an extreme upstream end of the aerosol-generating article.

6. The aerosol-generating article according to claim 1, wherein the aerosol-forming substrate comprises a gathered sheet of the homogenised tobacco material.

7. The aerosol-generating article according to claim 6, wherein the gathered sheet of homogenised tobacco material is crimped.

8. The aerosol-generating article according to claim 1, wherein the support element comprises a hollow tubular element.

9. The aerosol-generating article according to claim 8, wherein the support element further comprises a hollow cellulose acetate tube.

10. The aerosol-generating article according to claim 1, wherein the aerosol-cooling element is disposed immediately downstream of the support element and abuts the support element.

11. The aerosol-generating article according to claim 1, wherein the aerosol-cooling element comprises a gathered sheet of biodegradable polymeric material.

12. The aerosol-generating article according to claim 11, wherein the aerosol-cooling element further comprises a gathered sheet of polylactic acid.

13. The aerosol-generating article according to claim 1,
further comprising a mouthpiece disposed at an extreme downstream end of the aerosol-generating article,
wherein the outer wrapper circumscribes the mouthpiece.

14. The aerosol-generating article according to claim 13, wherein the mouthpiece comprises a plug of cellulose acetate tow.

15. An aerosol-generating system, comprising:
an aerosol-generating device comprising a heating element; and
an aerosol-generating article according to claim 1.

16. An aerosol-generating article for an aerosol-generating device comprising a heating element, the aerosol-generating article comprising:
an aerosol-forming substrate comprising between 5% and 30% by weight of an aerosol former, on a dry weight basis;
a support element disposed immediately downstream of the aerosol-forming substrate;
an aerosol-cooling element disposed downstream of the support element; and
an outer wrapper circumscribing the aerosol-forming substrate, the support element, and the aerosol-cooling element,
wherein the support element abuts the aerosol-forming substrate.

17. The aerosol-generating article according to claim 16, wherein the aerosol-forming substrate is penetrable by the heating element of the aerosol-generating device.

18. The aerosol-generating article according to claim 16,
further comprising a front plug upstream of the aerosol-forming substrate,
wherein the front plug is penetrable by the heating element of the aerosol-generating device, and
wherein the outer wrapper circumscribes the aerosol-forming substrate, the support element, the aerosol-cooling element, and the front plug.

19. The aerosol-generating article according to claim 16, wherein the support element is configured to resist a penetration force of at least 2.5 Newtons during insertion of the heating element of the aerosol-generating device into the aerosol-forming substrate.

20. The aerosol-generating article according to claim 16, wherein the aerosol-forming substrate is disposed at an extreme upstream end of the aerosol-generating article.

21. An aerosol-generating article for an aerosol-generating device comprising a heating element, the aerosol-generating article comprising:
an aerosol-forming substrate having a length of between 7 millimetres and 15 millimetres;
a support element disposed immediately downstream of the aerosol-forming substrate;
an aerosol-cooling element disposed downstream of the support element; and
an outer wrapper circumscribing the aerosol-forming substrate, the support element, and the aerosol-cooling element,
wherein the support element abuts the aerosol-forming substrate.

22. The aerosol-generating article according to claim 21, wherein the aerosol-forming substrate is disposed at an extreme upstream end of the aerosol-generating article.

23. An aerosol-generating article for an aerosol-generating device comprising a heating element, the aerosol-generating article comprising:
an aerosol-forming substrate;
a support element disposed immediately downstream of the aerosol-forming substrate;
an aerosol-cooling element disposed downstream of the support element, wherein the aerosol-cooling element comprises a gathered sheet of biodegradable polymeric material; and
an outer wrapper circumscribing the aerosol-forming substrate, the support element, and the aerosol-cooling element,
wherein the support element abuts the aerosol-forming substrate.

* * * * *